US009789942B2

(12) United States Patent
Rosenberg et al.

(10) Patent No.: US 9,789,942 B2
(45) Date of Patent: Oct. 17, 2017

(54) LARGE-SCALE WATERCRAFT STORAGE SYSTEM

(75) Inventors: Christian F. Rosenberg, St. Thomas, VI (US); William C. Maffett, Cookeville, TN (US); Brian D. Maffett, Cookeville, TN (US); Mark E. Williams, Henderson, NV (US)

(73) Assignee: Maff-Stack, LLC, Cookeville, TN (US)

( * ) Notice: Subject to any disclaimer, the term of this patent is extended or adjusted under 35 U.S.C. 154(b) by 262 days.

(21) Appl. No.: 12/281,327

(22) PCT Filed: Mar. 2, 2007

(86) PCT No.: PCT/US2007/005540

§ 371 (c)(1),
(2), (4) Date: May 26, 2009

(87) PCT Pub. No.: WO2007/103281

PCT Pub. Date: Sep. 13, 2007

(65) Prior Publication Data

US 2009/0304480 A1 Dec. 10, 2009

Related U.S. Application Data

(60) Provisional application No. 60/791,965, filed on Apr. 14, 2006, provisional application No. 60/778,325, filed on Mar. 2, 2006.

(51) Int. Cl.
*B63C 15/00* (2006.01)

(52) U.S. Cl.
CPC ..... *B63C 15/00* (2013.01)

(58) Field of Classification Search
CPC ..... B63C 3/06; B63C 15/00
(Continued)

(56) References Cited

U.S. PATENT DOCUMENTS 1,515,435 A 11/1924 Glover
3,029,913 A 4/1962 Liesenfeld
(Continued)

FOREIGN PATENT DOCUMENTS

DE 3937097 5/1990
FR 2552411 3/1985
(Continued)

OTHER PUBLICATIONS

Brochure "Marinas and Small Craft Harbors," authored by Tobiasson and Kollmeyer, published by Van Nostrand Reinhold, NY.

*Primary Examiner* — Jonathan Snelting
(74) *Attorney, Agent, or Firm* — Bradley Arant Boult Cummings LLP; Phillip E. Walker; Timothy L. Capria

(57) ABSTRACT

In a watercraft storage system a "wishbone" or U-shaped cradle liftable and rotatable by an overhead crane comprises adjustable air filled hull supports to either side of a boat hull and a keel support toward the stern of the watercraft. The cradle central opening clears a cantilever storage rack support beam assembly allowing the watercraft to be lowered onto or raised from the cantilever storage rack support beam assembly by an overhead traveling crane. To substantially reduce any longitudinal swaying of the cradle and watercraft during raising and lowering, a system or diagonal anti-sway bracing cables that automatically retract and extend is employed. In the preferred embodiment, the cradle is lowered into a water-filled channel within the storage structure to re-float the watercraft. A watercraft to be stored can be brought into the channel which contains alignment means to accurately position the watercraft over the cradle. The cradle can thereby be lifted properly, moved to a storage rack location and accurately stored on the cantilever storage rack support beam assembly.

13 Claims, 15 Drawing Sheets

(58) Field of Classification Search
USPC ..... 414/281–284, 140.1; 405/1–7
See application file for complete search history.

(56) References Cited

U.S. PATENT DOCUMENTS

| | | | | |
|---|---|---|---|---|
| 3,341,164 | A | 9/1967 | Ewing | |
| 3,362,172 | A | 1/1968 | Rutter | |
| 3,385,458 | A | 5/1968 | Gresham | |
| 3,687,308 | A * | 8/1972 | Apelstrand et al. | 14/71.3 |
| 3,786,942 | A | 1/1974 | Dane, Jr. | |
| 3,802,580 | A | 4/1974 | Castaldi | |
| 4,070,979 | A | 1/1978 | Otis et al. | |
| 4,190,013 | A | 2/1980 | Otis et al. | |
| 4,227,828 | A | 10/1980 | Ivanov et al. | |
| 4,268,207 | A | 5/1981 | Pipes | |
| 4,372,724 | A | 2/1983 | Stolzer | |
| 4,488,847 | A | 12/1984 | Stolzer | |
| 4,502,406 | A | 3/1985 | Merry | |
| 4,640,214 | A | 2/1987 | Bruns | |
| 4,726,316 | A | 2/1988 | Bruns | |
| 4,787,804 | A | 11/1988 | Edenas | |
| 4,797,055 | A | 1/1989 | Tworoger et al. | |
| 4,953,488 | A | 9/1990 | Heidtmann | |
| 4,971,505 | A | 11/1990 | Sawyer | |
| 4,979,869 | A | 12/1990 | Mullin, Jr. | |
| 5,011,357 | A | 4/1991 | Studler | |
| 5,018,926 | A | 5/1991 | Sternad | |
| 5,238,348 | A | 8/1993 | Reimer | |
| 5,487,636 | A | 1/1996 | Mkrtchyan | |
| 5,882,170 | A | 3/1999 | Walton | |
| 6,007,288 | A | 12/1999 | Maffett et al. | |
| 6,099,014 | A | 8/2000 | McLaughlin | |
| 6,162,003 | A | 12/2000 | Gruner | |
| 6,189,909 | B1 | 2/2001 | Danchuk | |
| 6,257,159 | B1 * | 7/2001 | Siegmann | 114/45 |
| 6,263,820 | B1 | 7/2001 | Crifase et al. | |
| 6,327,990 | B1 | 12/2001 | Crifase et al. | |
| 6,446,997 | B1 | 9/2002 | Bergman et al. | |
| 6,490,987 | B1 | 12/2002 | Crifase et al. | |
| 6,520,728 | B1 | 2/2003 | Schwitters | |
| 6,612,602 | B1 | 9/2003 | MacKarvich | |
| 6,644,231 | B2 | 11/2003 | Crifase et al. | |
| 6,719,317 | B1 | 4/2004 | Grovender et al. | |
| 6,752,099 | B1 | 6/2004 | Crifase et al. | |
| 7,112,007 | B2 | 9/2006 | Maffett et al. | |
| 2002/0176767 | A1 | 11/2002 | Gisselberg | |
| 2005/0035259 | A1 * | 2/2005 | Maffett et al. | 248/346.06 |

FOREIGN PATENT DOCUMENTS

| | | |
|---|---|---|
| GB | 882343 | 11/1961 |
| JP | 02048311 | 2/1990 |
| JP | 02088853 | 3/1990 |
| JP | 02183055 | 7/1990 |
| JP | 02241891 | 9/1990 |
| JP | 03119270 | 5/1991 |

* cited by examiner

FIG 11
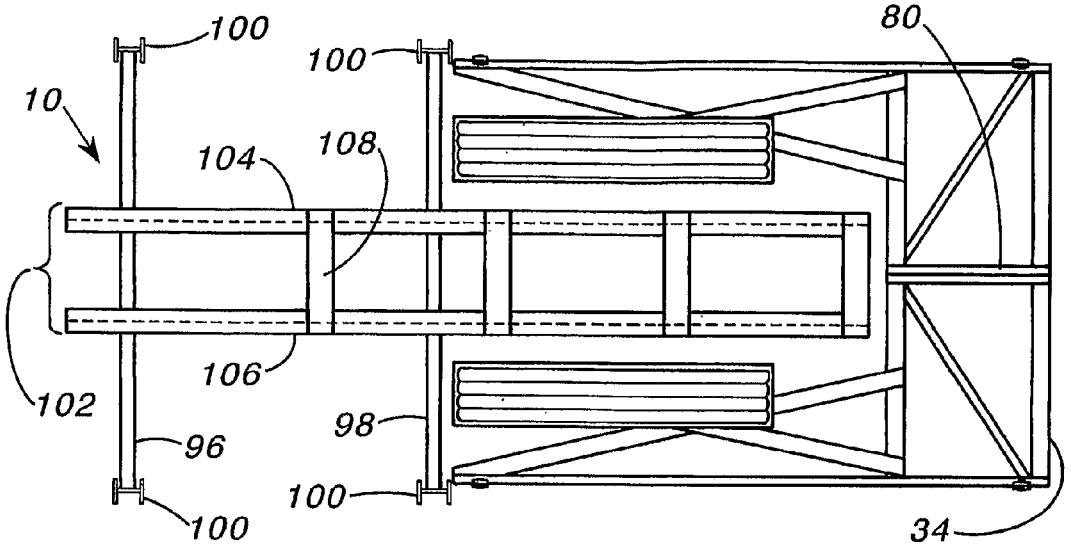
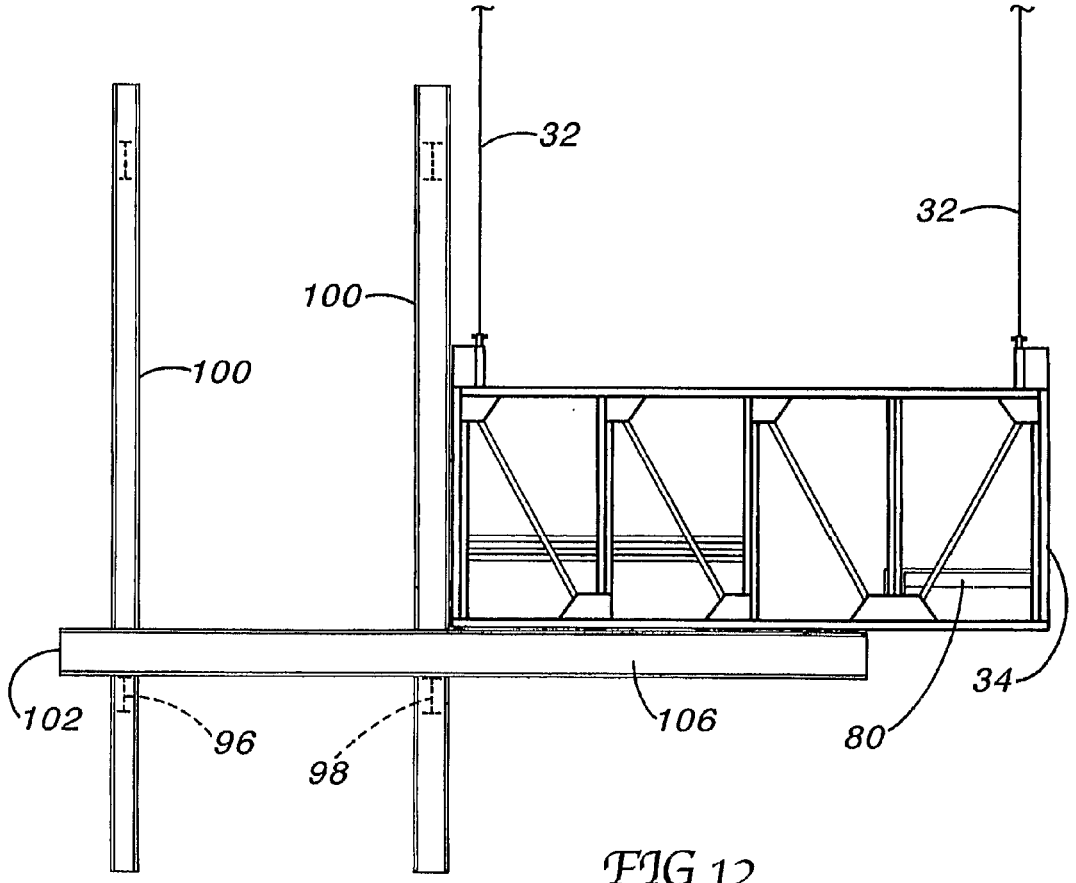
FIG 12

FIG 15
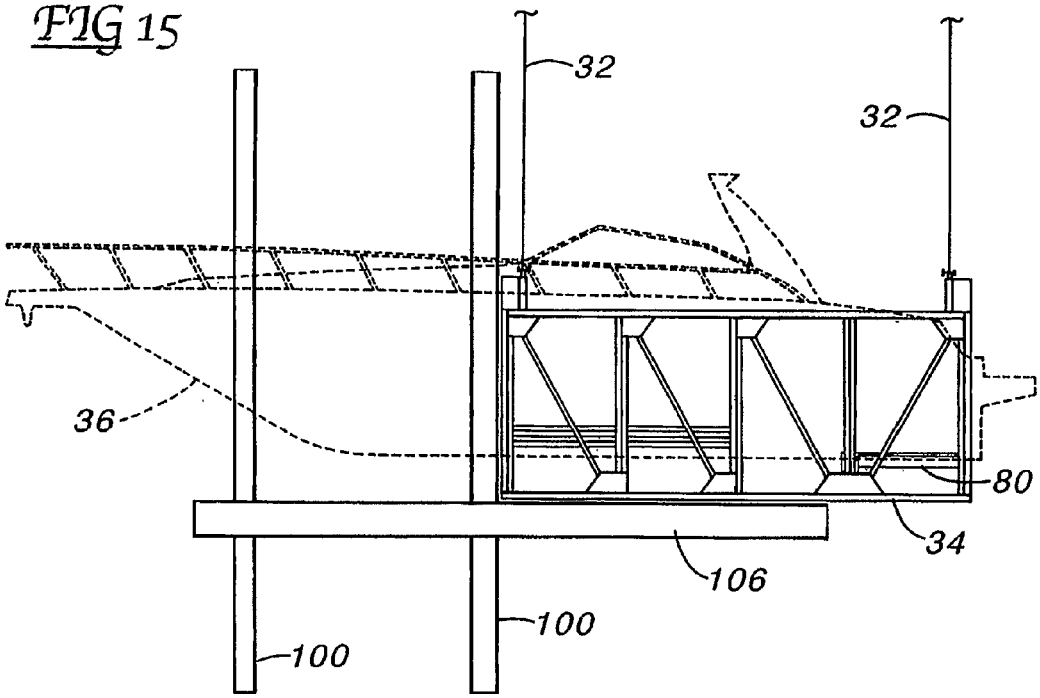
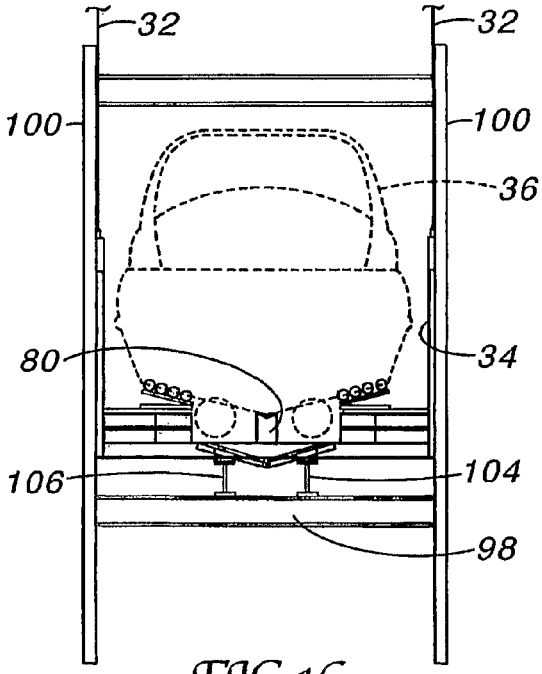
FIG 16
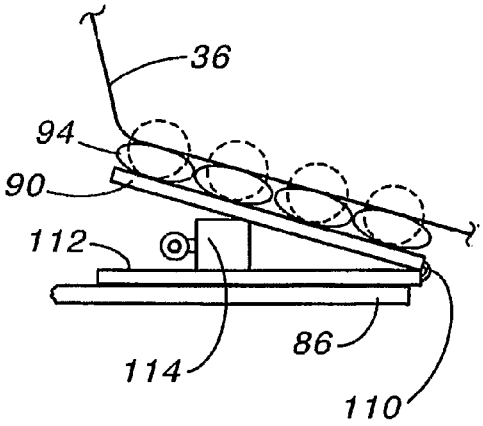
FIG 17

LARGE-SCALE WATERCRAFT STORAGE SYSTEM

This application is a national stage entry of PCT/US2007/005540 filed on Mar. 2, 2007, and claims priority to provisional application 60/791,965 filed on Apr. 14, 2006, and claims priority to provisional application 60/778,325 filed on Mar. 2, 2006. The field of the invention pertains to large-scale warehouse and boat storage facilities and, in particular, to the out-of-water storage of motor yachts.

BACKGROUND OF THE INVENTION

For storage and repair, motor yachts of about 30 to 80 feet in length are typically hauled from the water in slings suspended from wheeled gantry cranes or in cradles riding on marine railways. Larger yachts require marine railways or dry docks. Smaller yachts utilize trailers towable behind vehicles—usually trucks.

Powerboats and yachts above about 25 feet in length typically are stored outdoors on trailers or cradles. On occasion, they are stored on wooden blocks and supports. Small boats below about 20 feet in length are now often stored in warehouses on racks. The small boats are placed in, or removed from, the racks with forklift trucks ("hi-lo's"). Such trucks are inadequate for larger boats and yachts for a variety of reasons.

Since indoor warehousing of a wide variety of other objects up to and including the size of automobiles has become common, there has been some development of more convenient and safer warehousing for small boats. Illustrative of such warehousing is U.S. Pat. No. 6,007,288 wherein the warehouse is equipped with a traveling overhead crane having a specialized cradle to lift a boat. The boat racks comprise frame assemblies to support rack assemblies having cantilever beams to support the boats. While practical for small boats, such a warehousing system is not practical for large powerboats and yachts.

U.S. Pat. No. 3,786,942 discloses an overhead traveling crane for carrying boats in suspended slings. The suspended slings descend from a first frame that is carried by a second frame in direct suspension from the traveling crane. The first frame is movable horizontally and remains with the stored boat in a rack.

U.S. Pat. Pub. No. 2002/0176767 discloses a rotatable forklift that travels on rails into and out of the storage area to place boats in storage racks. This design allows relatively low warehouses with low doors to be used.

Japanese Pat. Pub. No. 2-183055 and No. 2-241891 disclose a relatively low tower for lifting a boat from the water or a trailer and transferring the tower and boat to a second lift where the tower and boat are lifted to a storage location in a rack. The boat is supported on a frame that is moved into, or retrieved from, the storage location.

French Pat. Pub. No. 2552411 discloses an overhead traveling crane with a telescopic retrieval device for lifting boats from underneath and depositing them in racks for storage.

U.S. Pat. No. 4,190,013 discloses an overhead traveling crane with a rotator and a telescopic frame hanging therefrom to lift relatively small boats to storage locations. U.S. Pat. No. 6,162,003 discloses a honeycomb cell-like storage configuration that is particularly directed to sailing yachts with deep keels and substantial draft. The individual boats are supported on individual cradles that, in turn, slide or roll into individual cells.

While suitable for small watercraft storage, the devices of the prior art are not practical for the storage and retrieval of large power yachts weighing many tons and worth hundreds of thousands, and sometimes millions, of dollars.

SUMMARY OF THE INVENTION

This application discloses further improvements on the watercraft storage systems disclosed in U.S. Pat. No. 6,007,288 and International Publication No. WO 2005/073074 A2, which are incorporated herein by reference. In particular, the new improvements are directed to the storage of boats lying in size and weight between the boats contemplated in the patent, and publication just above but these improvements are not necessarily limited thereto.

The new improvements comprise a new U-shaped or "wishbone" cradle that better supports a boat and allows easy placement and retrieval of a boat into and from a cantilever storage rack. The system as a whole is improved by a channel within the storage structure fitted with features for alignment of a boat therein to quickly facilitate placement of a boat on a cradle. The cradle provides full support of the keel adjacent the stern and fall support of the hull to either side of the cradle central opening and well ahead of the boat center of gravity.

Further new improvements comprise components of the anti-sway cable system that diagonally braces the suspended cradle and any boat thereon. The diagonal bracing cables suppress longitudinal sway which must be substantially prevented as the cradle is raised, lowered, translated horizontally, or rotated. Each of the diagonal bracing cables shorten or lengthen as the cradle is raised or lowered while maintaining proper tension to prevent sway. The proper tension is provided by a rotatable drum upon which the cables wind and unwind. The rotatable drum is preferably controlled by a dynamic brake and motor connected thereto.

BRIEF DESCRIPTION OF THE DRAWINGS

FIG. 11 is a plan view of the boat cradle in position to place or retrieve a boat from a storage location;

FIG. 12 is a side elevation of the boat cradle in position just above the boat support of a storage location;

FIG. 15 is a side elevation showing the location of a boat on the cradle but in position for storage;

FIG. 16 is a stern end elevation showing the location of a boat on the cradle but in position for storage;

FIG. 17 is a detail of the cradle cushion supports for the boat amidships;

DESCRIPTION OF THE PREFERRED EMBODIMENTS

Figure 1:
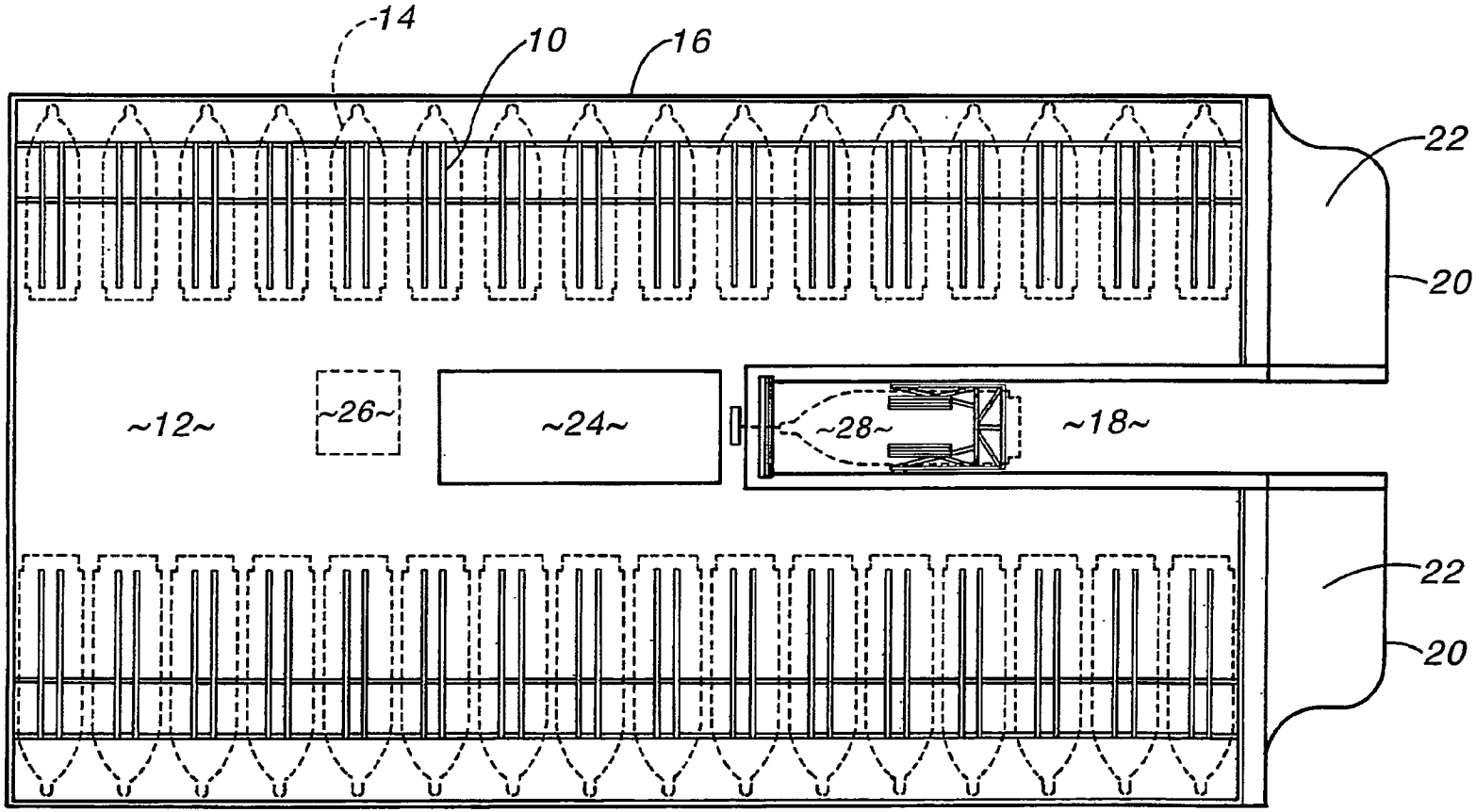
FIG. 1 is a plan view of the boat storage facility showing a typical level of boat storage.

Illustrated in FIG. 1 is a plurality of racks 10 to either side of a central gallery 12 for storage of a plurality of boats 14 all inside a substantial structure 16. The structure 16 is located adjacent a canal, stream or other body of water whereby a channel 18 can lead into the structure gallery 12. There may be tie-up locations 20 on walkways 22 outside the structure. Beyond the channel 18 are a hull washing and drying station 24 and a cradle adjusting station 26 both in the gallery 12. Within the channel 18 is a cradle and boat raising and lowering location 28 in which the boats' position is variable depending on the length and center-of-gravity of the boat.

Figure 2:
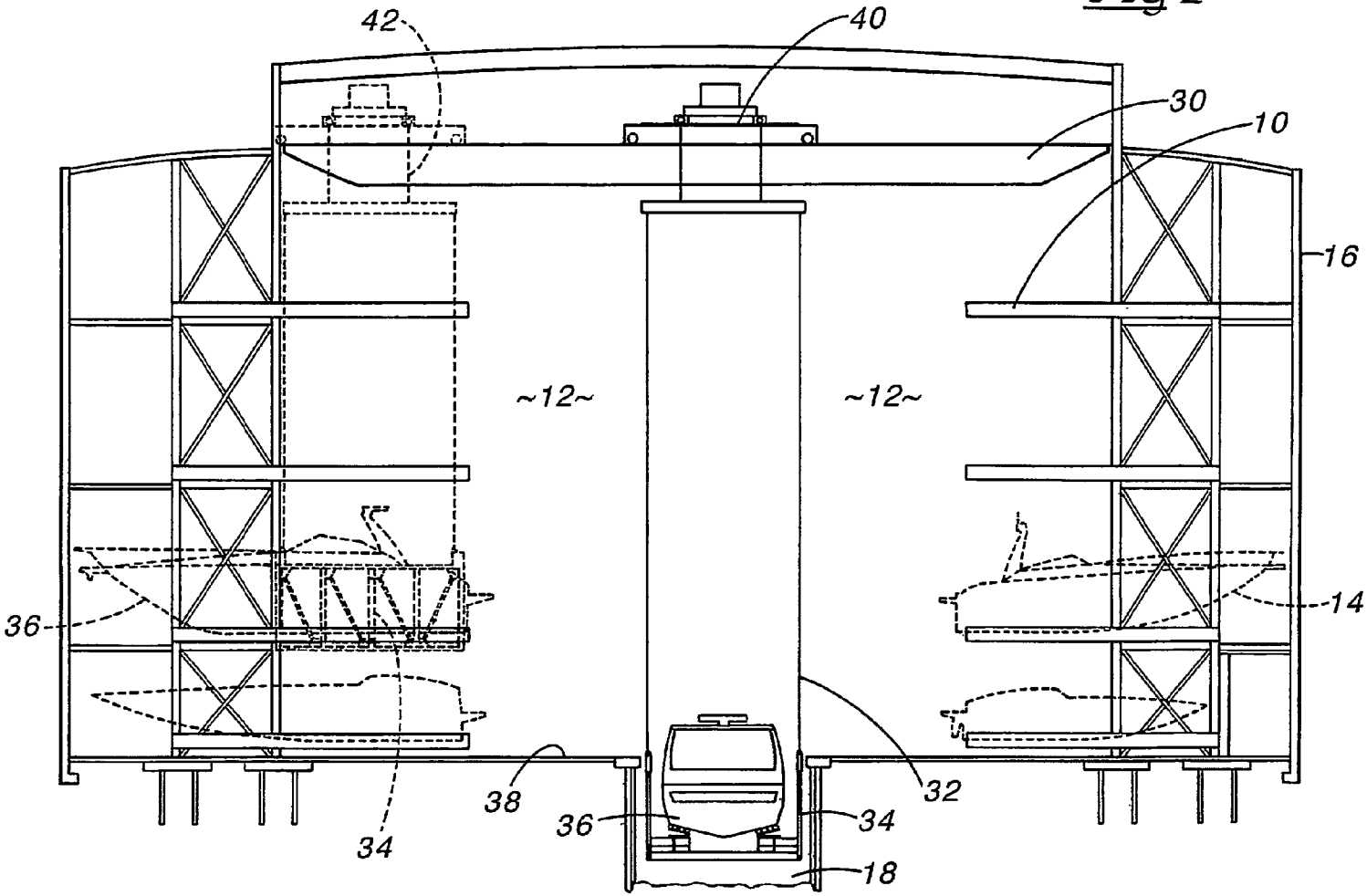
FIG. 2 is a lateral elevation view of the boat storage facility.
Figure 3:
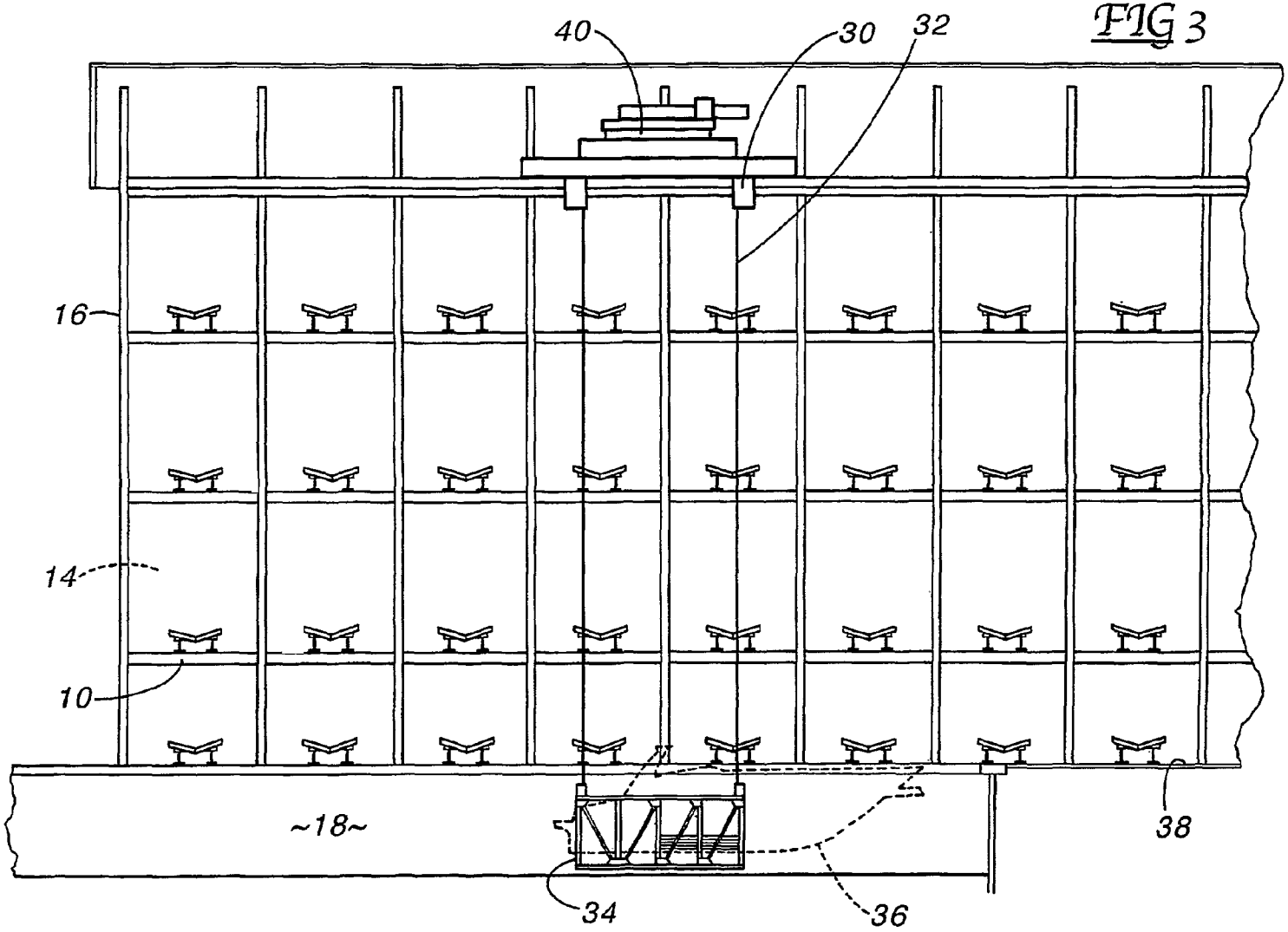
FIG. 3 is a longitudinal elevation view of the boat storage facility from within the gallery.

Referring to FIGS. 2 and 3, there are four levels of boat storage racks 10 totaling 128 racks for boats; however, more or less total racks can be accommodated by changing the length or height of the structure 16. Supported above the gallery 12 is a traveling overhead crane 30 movable the length of the structure above the gallery and racks 10. Suspended on a plurality of cables 32 is a specially shaped boat cradle 34 and boat 36 that can be lowered into or raised from the channel 18 at location 28. Once above the gallery 12 floor 38, a rotator 40 on the traveling crane 30 allows the cradle 34 and boat 36 to be rotated 90° to either side for placement on a rack 10. With the boat 36 and cradle 34 rotated 90°, the traveling crane 30 can move longitudinally and laterally to the position shown in dashed outline 42 and put the cradle and boat in position for placement on a rack 10.

Figure 4:
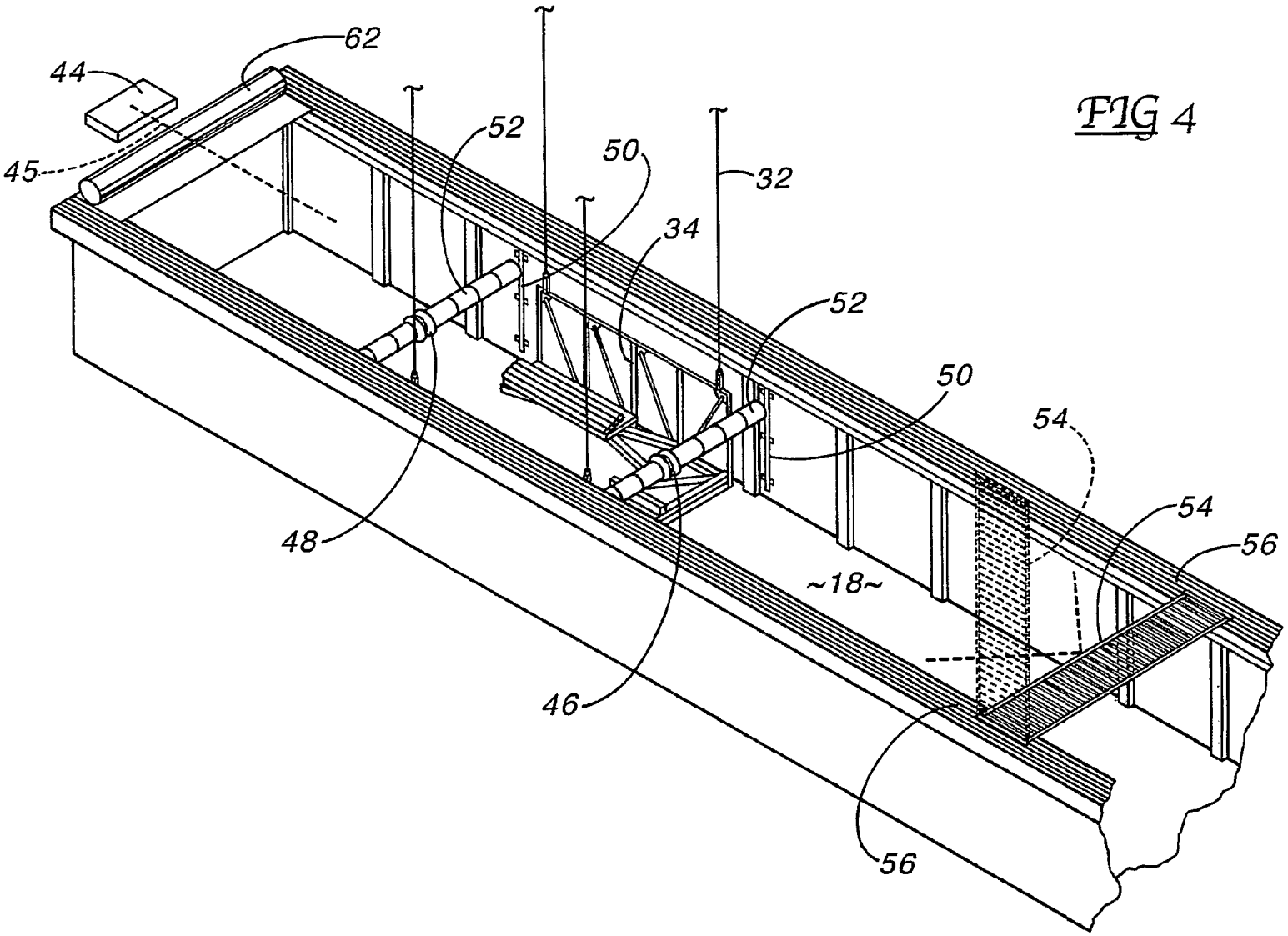
FIG. 4 is a partial perspective view of the water channel extending within the boat storage facility.
Figure 5:
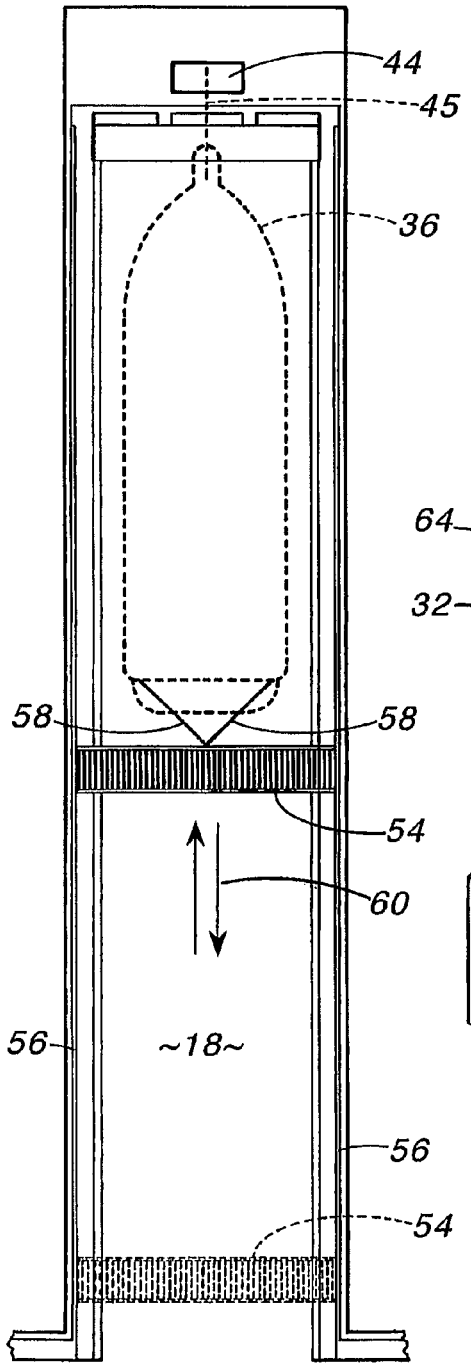
FIG. 5 is a plan view of the water channel of FIG. 4.

In FIGS. 4 and 5, the channel 18 is equipped with several important features for moving a boat and positioning a boat properly in the cradle 34. As a boat 36 is towed bow first into the channel 18 by a winch 44 and cable 45, the boat keel engages a V-roller 46 and a second V-roller 48 mounted on shafts. The ends of the shafts are mounted in blocks that, in turn, allow the shafts to move vertically in tracks 50 on the channel sidewalls. The shafts are covered by floatation cylinders 52 which allow the V-rollers 46 to remain at the water surface when unengaged and to engage the boat keel from underneath when submerged. Thus, the boat automatically becomes properly aligned laterally in the channel 18. The boat 36 can then be lifted by the cradle 34 from the channel 18.

When a boat 36 enters or is retrieved and is raised or lowered into the channel 18, a movable catwalk 54 is lowered over the channel 18 in the manner of a draw-span and then moved on rails 56 to a location adjacent the stern of the boat. A pair of equal length lines 58 is attached to the stern and catwalk 54, as shown, and the catwalk drawn back in the direction of arrow 60 to remove or insert the boat from or into the raising and lowering location 28.

The channel 18 also includes a cover 62 that may be drawn out to cover the channel when the structure 16 is otherwise completely closed, thereby sealing off the channel from the interior of the structure. The channel cover 62 drum may be as shown or down in the channel 18 to better clear winch cable 45 but above the high water level in the channel.

Figure 6:
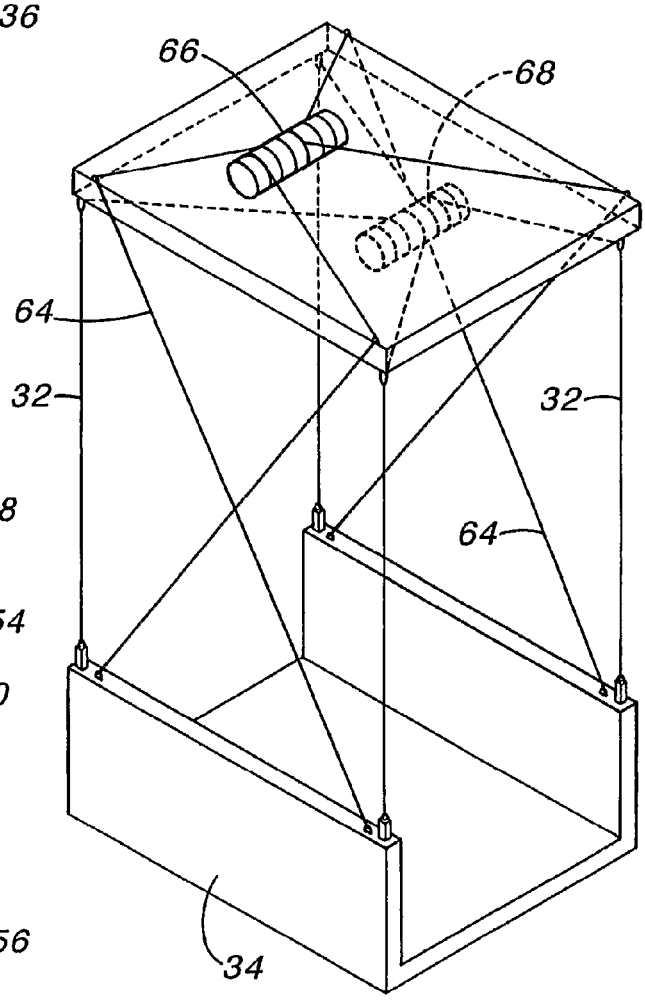
FIG. 6 is a perspective schematic view of the boat hoisting apparatus.
Figure 7:
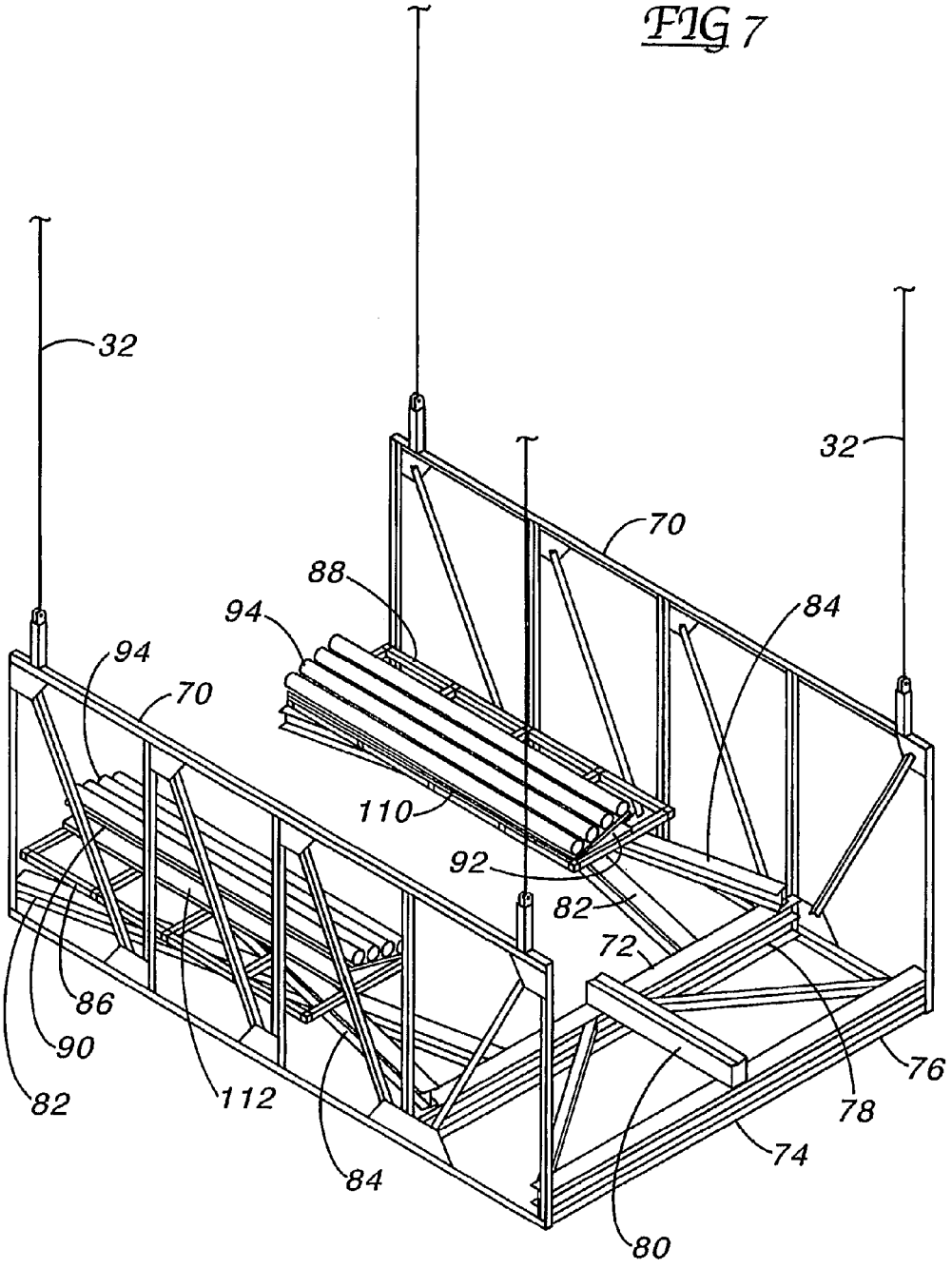
FIG. 7 is a perspective view of the new boat cradle for the system.
Figure 8:
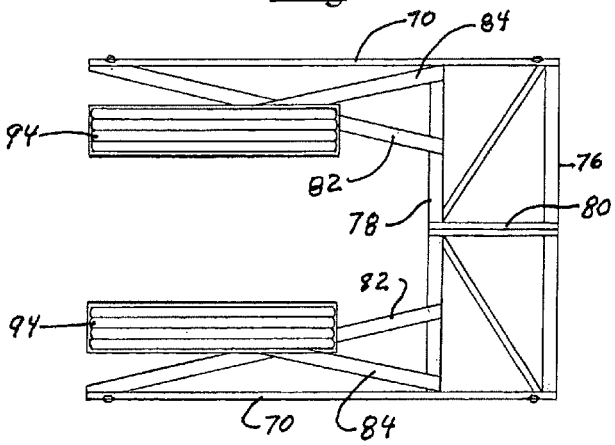
FIG. 8 is a plan view of the boat cradle of FIG. 7.
Figure 9:
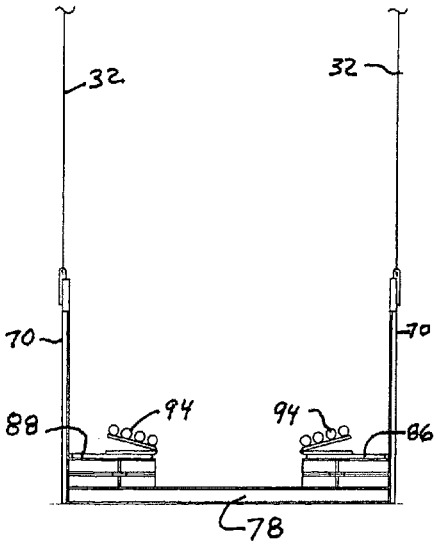
FIG. 9 is a bow end elevation of the boat cradle of FIG. 7.
Figure 10:
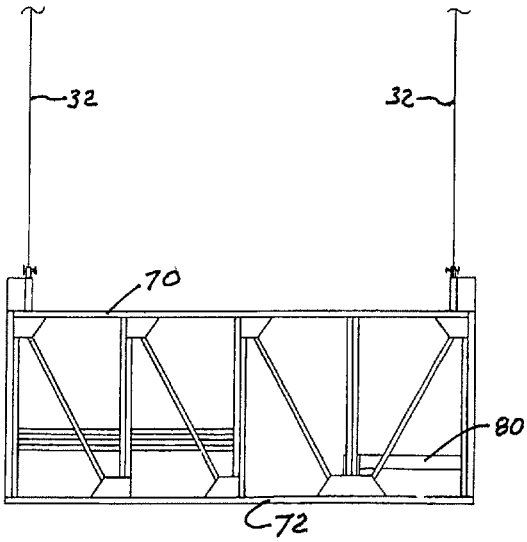
FIG. 10 is a side elevation of the boat cradle of FIG. 7.

In FIG. 6, a system of anti-sway cables is depicted. The anti-sway cables 64 diagonally brace the suspended cradle 34 longitudinally to prevent sway as the cradle is raised, lowered, translated horizontally, or rotated. As the vertical cables 32 shorten or lengthen as the cradle 34 is raised or lowered, the anti-sway cables 64 must also shorten or lengthen while providing adequate tension to prevent sway. The proper tension is provided by a rotatable drum 66 for winding the cables 64 and a dynamic brake and motor connected to the drum. The drum 68 for the lifting cables 32 is also illustrated in dashed outline. The anti-sway cable system is further explained below.

Illustrated in FIGS. 7, 8, 9 and 10 is the boat cradle 34 in detail. The sides 70 of the cradle 34 are of generally open truss work, and the base 72 is U-shaped of open truss work. At the stern end 74 are two lateral frame pieces 76 and 78 that connect the sides 70 together and support a keel block 80 shaped to engage and support the boat keel near the boat stern. Forward of the lateral frame pieces 76 and 78 are pairs of support beams 82 and 84 to provide outboard support to platforms 86 and 88. The platforms 86 and 88 are also attached to the sides 70 of the cradle 34. Slideable on top of each platform 86 and 88 are smaller platforms 90 and 92 hinged together which, in turn, support air cushioning means 94 for contact with the boat hull. As shown, the air cushioning means 94 comprises firehose tubes which have been found to be quite suitable. Inflatable tubes or other inflatable devices may also be used for cushioning. The smaller hinged platforms 90 and 92 can be simply wedged up or down and slid in or out to fit the individual boat hull shape.

Figure 13:
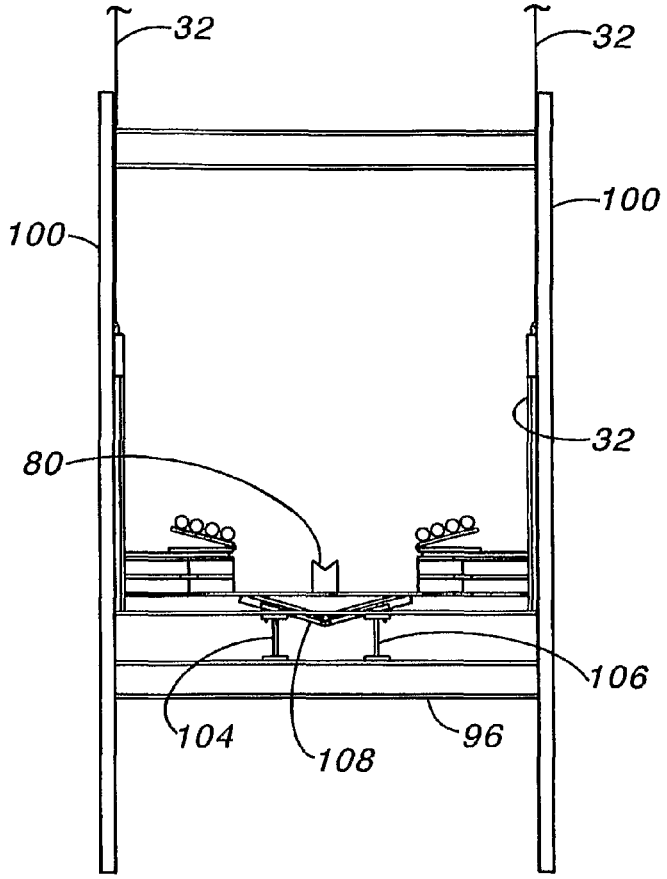
FIG. 13 is a bow end elevation of the boat cradle in position just above the boat support of the storage location.

FIGS. 11, 12, and 13 illustrate the positioning of the cradle 34 in relation to a rack 10. Each rack 10 comprises a pair of horizontal beams 96 and 98 spanning between vertical post beams 100, the latter forming a basic part of the overall structure 16. Centrally located on and supported by the horizontal beams 96 and 98 is a cantilever beam assembly 102 comprising two parallel horizontal beams 104 and 106 and a plurality of V-shaped cross-members 108. The cross-members 108 are formed or adjustable to match the keel and the hull shape of a particular boat and are preferably located beneath bulkheads of the boat. Thereby, the boat can be supported in the rack 10 for long periods of time without warpage or other damage to the hull.

As shown in FIG. 12, the cradle 34 is positioned just above the horizontal beams 104 and 106 of the cantilever beam assembly 102. The U-shape of the cradle 34 fits around the cantilever beam assembly 102 as best shown in FIG. 11. The cradle 34, being suspended on the cables 32, thus can be raised and lowered above and below the cantilever beam assembly 102 without contact between them.

Figure 14:
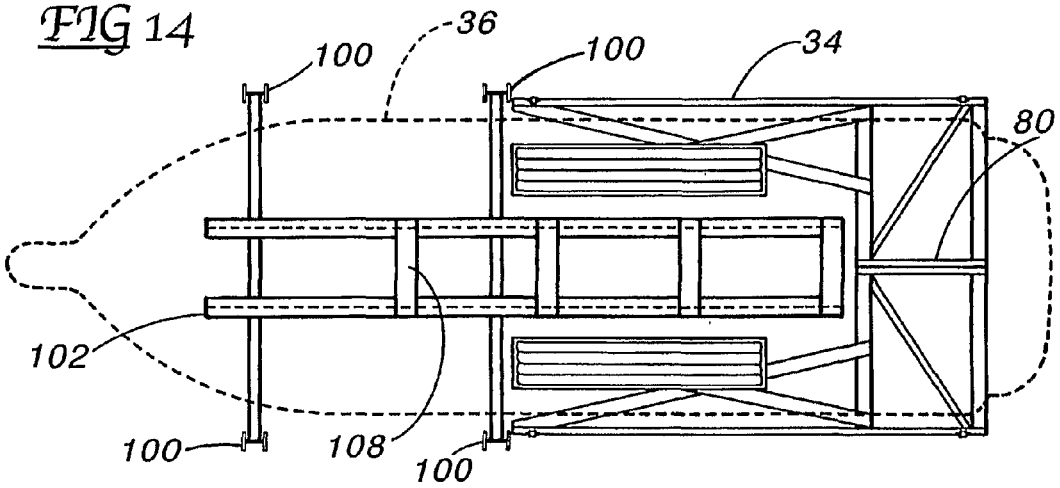
FIG. 14 is a plan view showing the location of a boat on the cradle but in position for storage.

In FIGS. 14, 15 and 16, the outline of a boat 36 has been added to illustrate the position of the boat on the cradle 34 and just above the cantilever beam assembly 102. The boat 36 bow extends well beyond the rack 10 and cradle 34; however, the boat beam and center of gravity is well within the cradle. Lowering the cradle 34 from the position shown rests the boat 36 on the V-shaped cross-members 108, and the cradle can be backed out sternwise by the overhead crane 30.

For retrieval of a boat 36, the cradle 34 is brought into the cantilever beam assembly 102 and raised, lifting the boat off the cross-members 108 and above the assembly to the position shown. The cradle 34 carrying the boat 36 can then be moved sternwise horizontally to retrieve the boat.

The detail of FIG. 17 illustrates the hinged platform 90 supporting the cushioning means 94 and boat 36 hull. The hinged platform 90 includes a hinge 110 along one side fastened to a horizontal platform 112 which, in turn, slides on platform 86. Thus, cushioning means 94 can be moved horizontally and rotated upwardly to engage a boat hull as required. To retain the cushioning means 94 at the correct angle, wedges 114 are placed or driven into the position shown between platform 90 and platform 112. Screw jacks or hydraulic lifts might also be used to raise and lower and to slide platforms 90 and 92.

Figure 18:
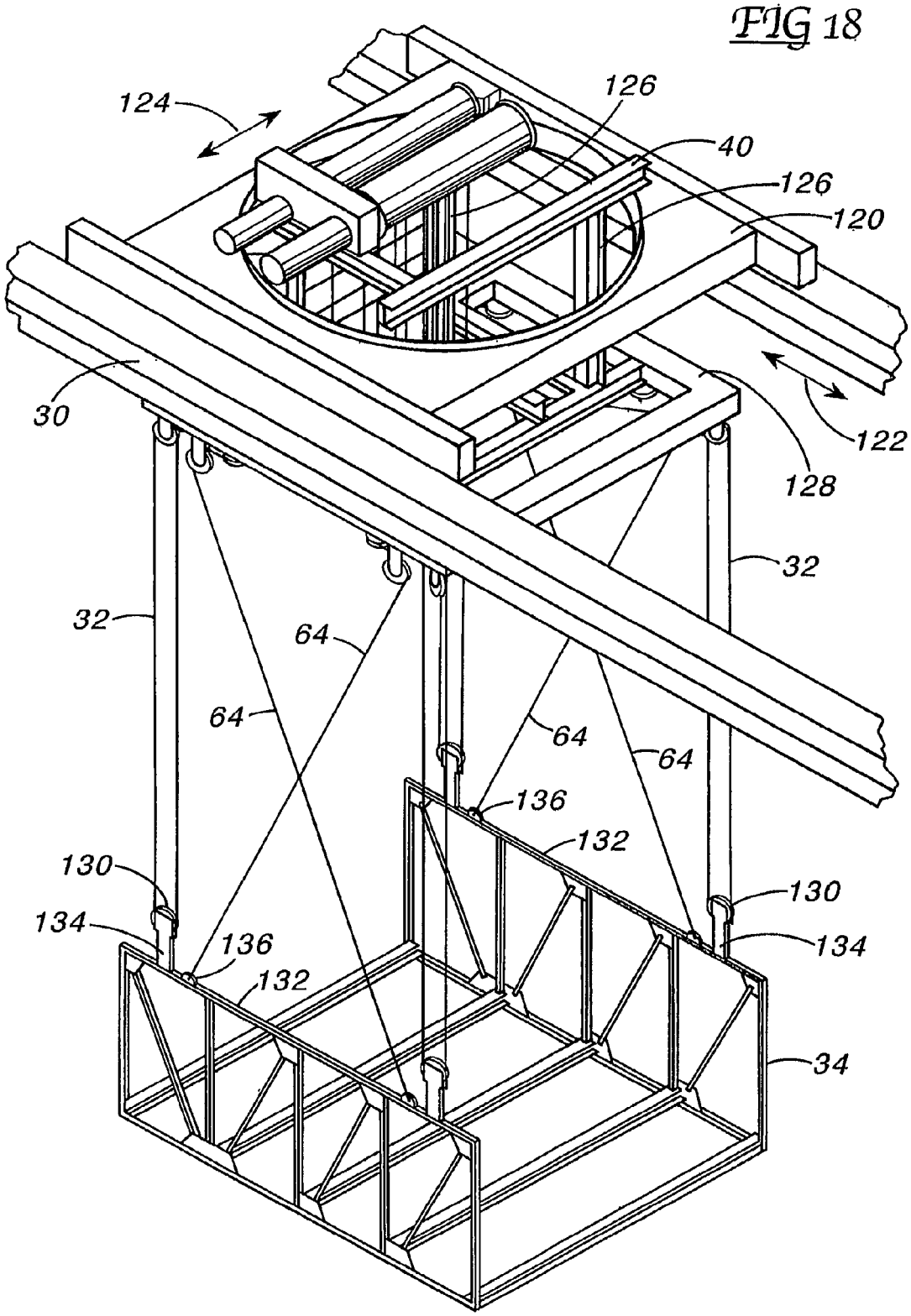
FIG. 18 is a perspective view of the anti-sway bracing system from above the traveling overhead crane.

In FIG. 18, the overhead traveling crane 30 movably supports a rotator carriage 120 which can translate in the direction of arrow 122 perpendicular to movement 124 of the crane. The rotator carriage 120 in turn supports the rotator 40 shown schematically. The rotator 40 includes descending vertical columns 126 which connect to a pulley frame 128. All of these components are of very robust steel construction.

Figure 19:
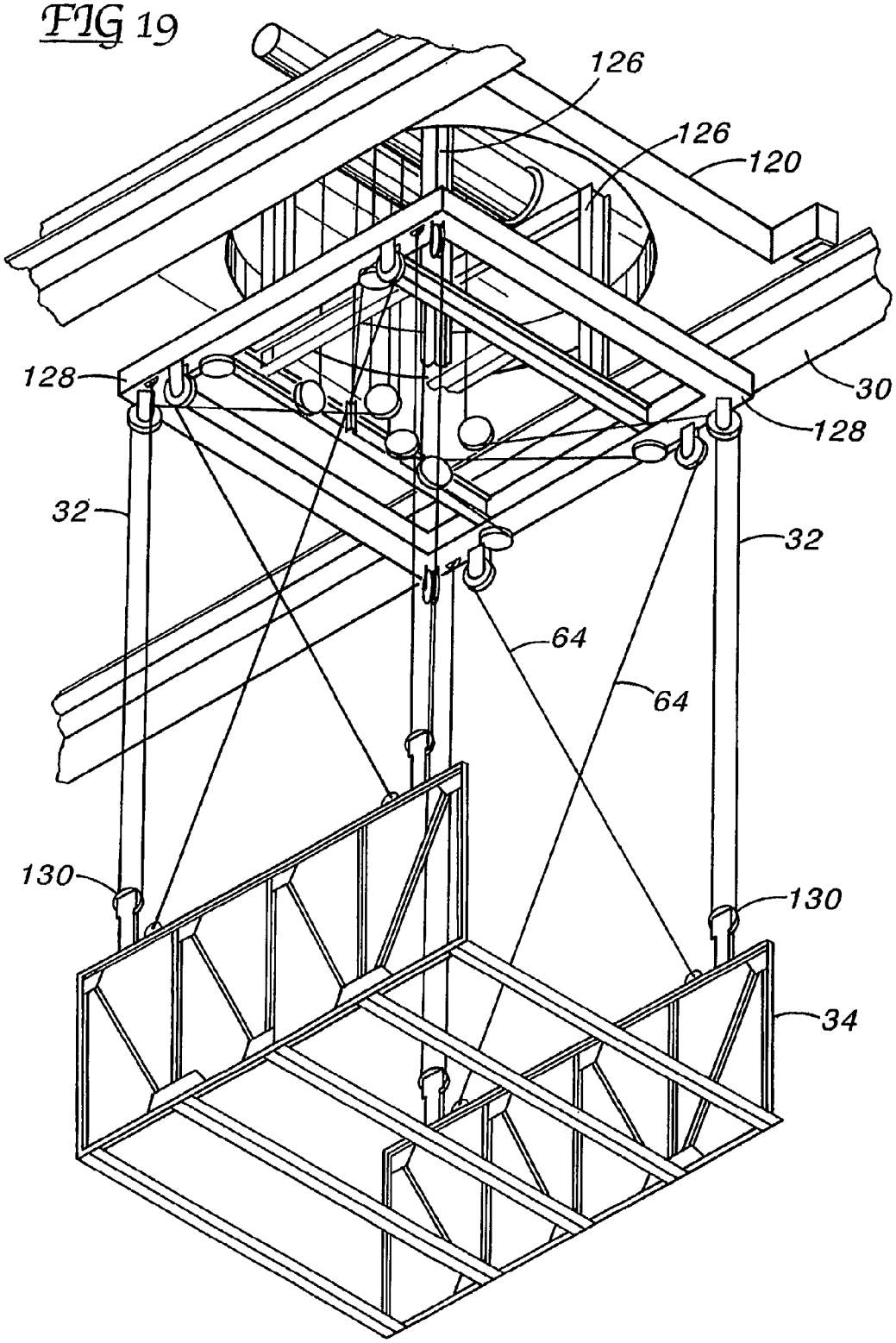
FIG. 19 is a perspective view of the anti-sway bracing system from below the traveling overhead crane.

The pulley frame 128 supports two separate descending cable systems as also illustrated in FIG. 19. Vertical lifting cables 32 perform the function of raising and lowering the cradle 34. In FIG. 6, the vertical cables are shown as single cables 32 at the "four corners" of a square or rectangular horizontal pattern. In contrast, in FIGS. 18 and 19, the corner cables 32 pass through pulleys 130 attached to the cradle 34. The anti-sway bracing cables 64, however, are single cables also connected adjacent the "four corners" to the cradle 34. Physically, the upper rails 132 of the cradle 34 provide locations for attachments 134 of the vertical cables 32 and attachments 136 of the diagonal bracing cables 64.

Figure 20:
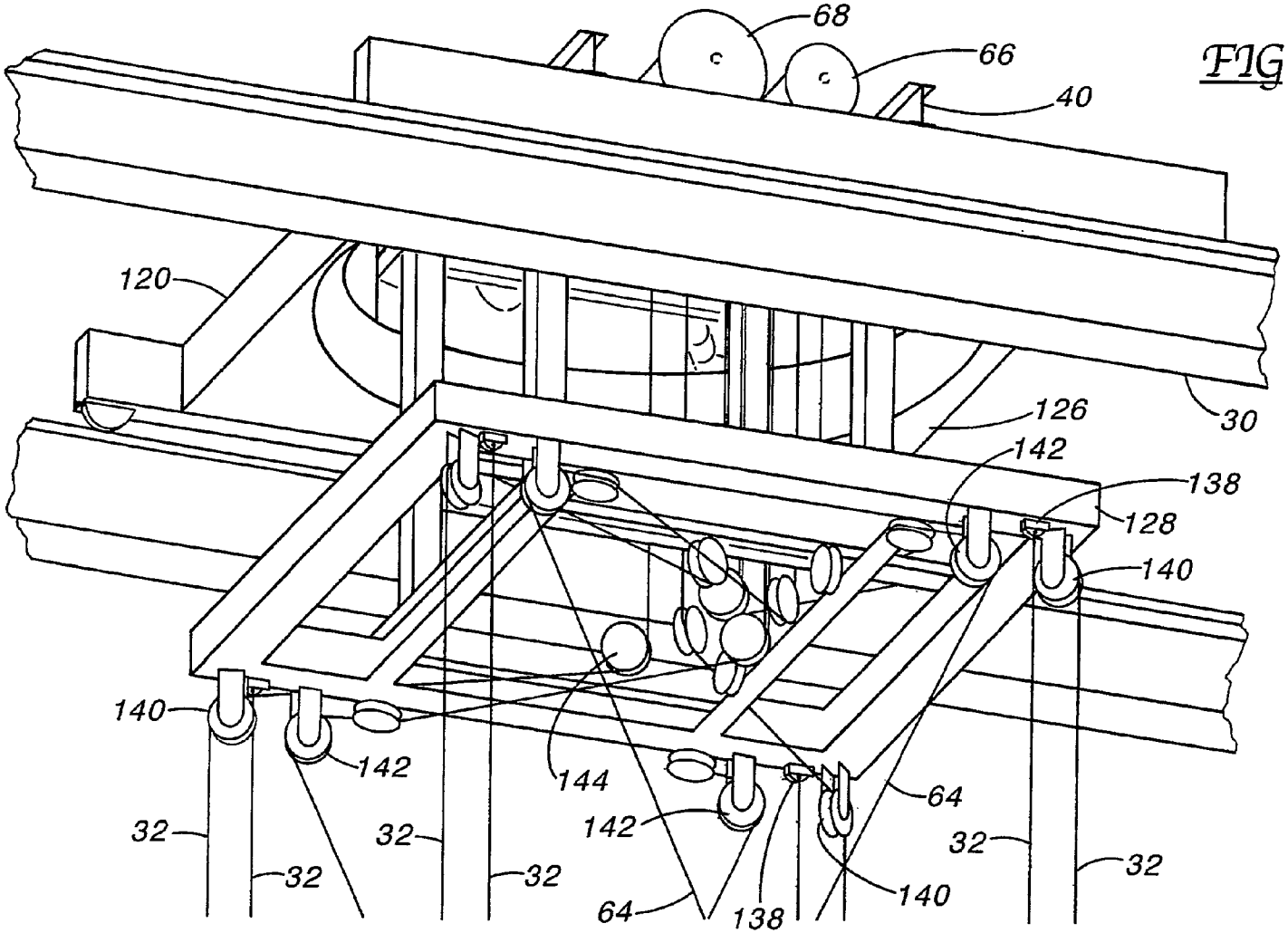
FIG. 20 is a close-up perspective view of the cable and pulley system from below the traveling overhead crane.
Figure 21:
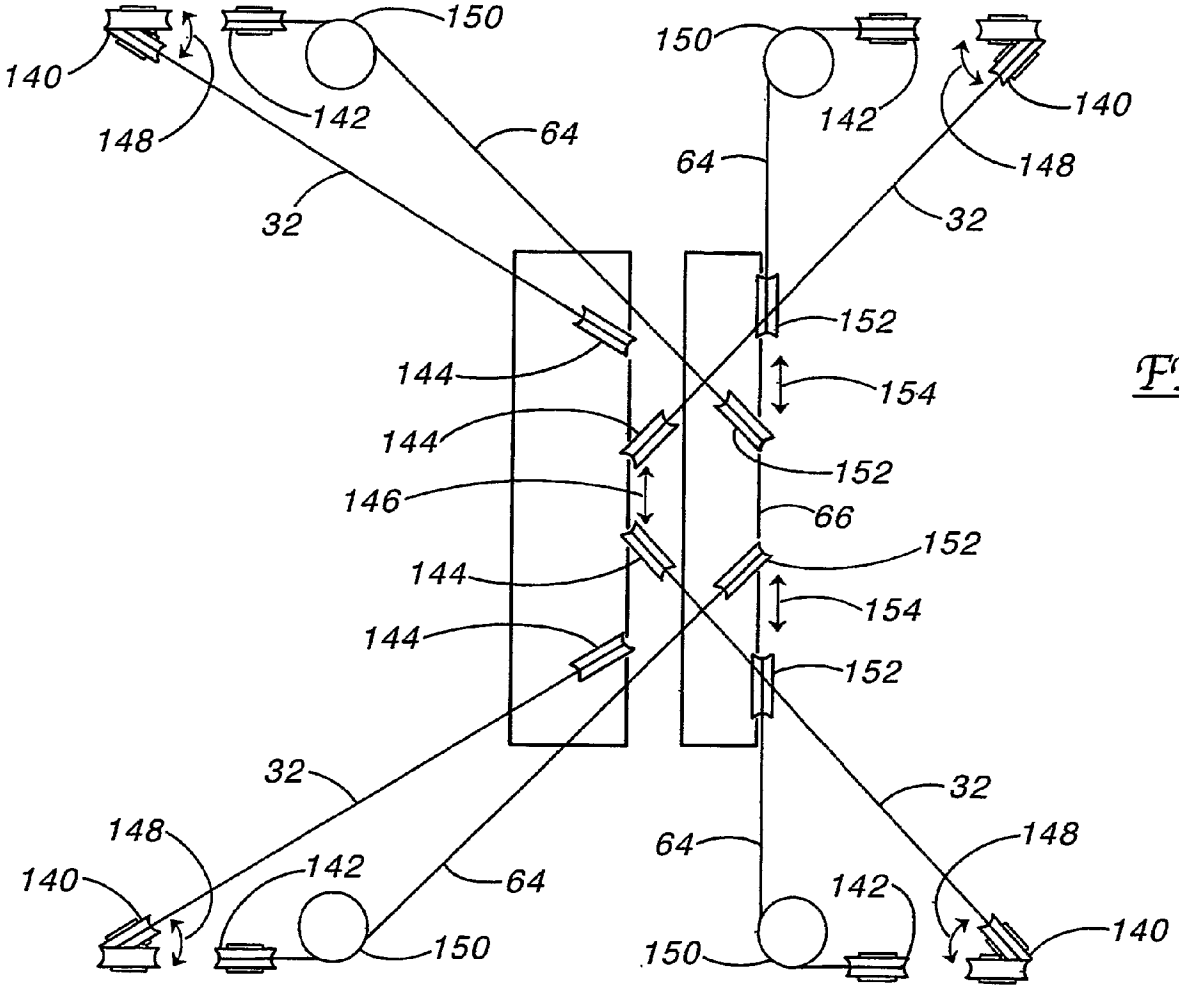
FIG. 21 is an underneath schematic plan view of the drums, cables and pulleys at the top of the anti-sway bracing system.
Figure 22:
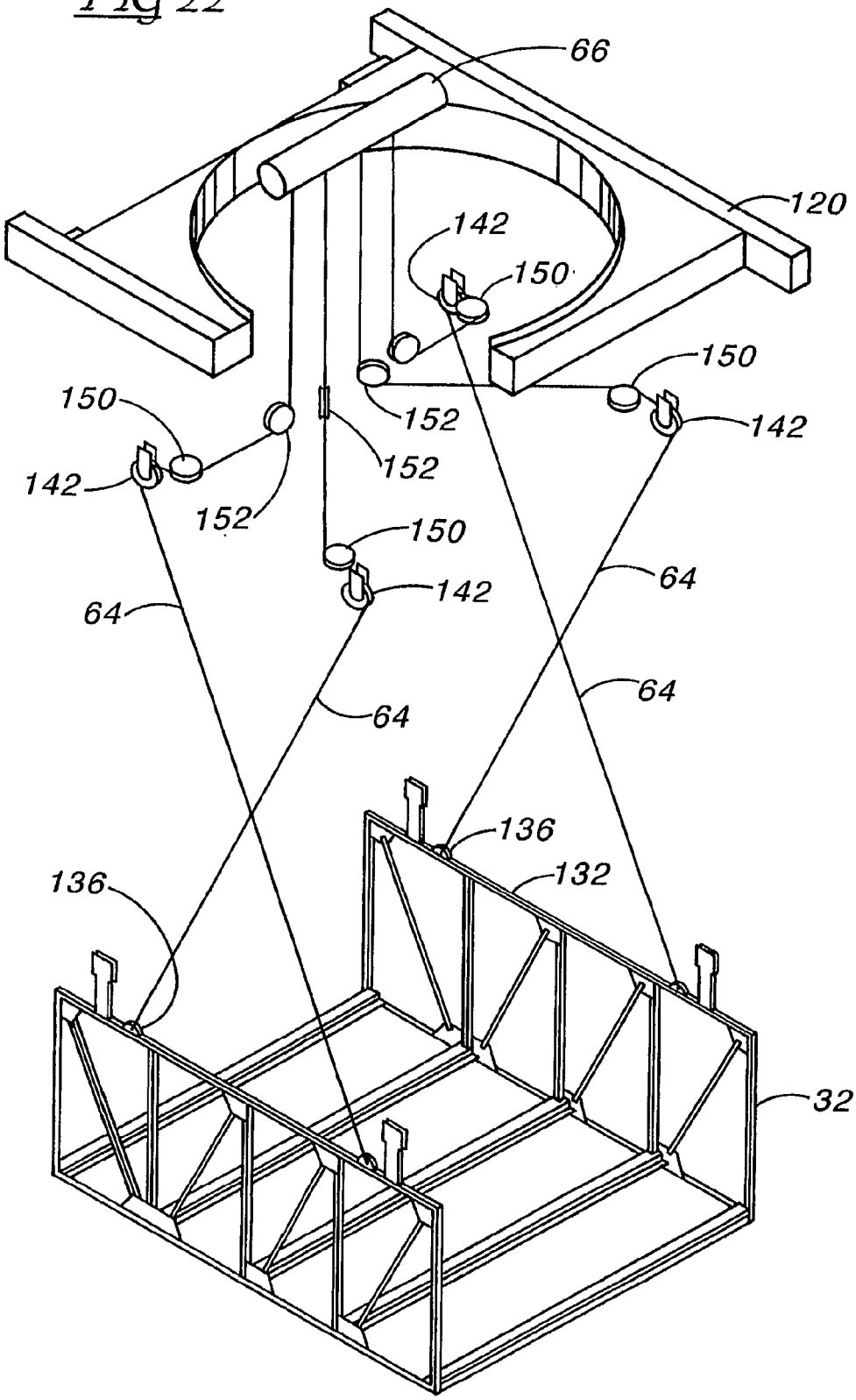
FIG. 22 is an overhead perspective schematic view of the anti-sway bracing cables and pulley system.

Thereabove, the pulley frame 128 supports a plurality of pulleys for both the vertical cables 32 and the bracing cables 64. The pattern of pulleys attached to the pulley frame 128 are best shown in FIGS. 20 to 22 wherein in FIG. 20 the pulley frame replicates the "four corners" pattern as described for the cradle 34. The vertical cables 32 at each corner of the pulley frame 128 attach at 138 and pass over pulleys 140. Adjacent each corner are pulleys 142 over which pass the bracing cables 64. Atop the rotator 40 are the drum 68 for the vertical lifting cables 32 and the drum 66 for the bracing cables 64.

Referring to FIG. 21, the four cables 32 are horizontally directed from pulleys 140 to pulleys 144 which, in turn, direct the cables upwardly to drum 68. Drum 68 is preferably electric motor powered to raise and lower the cradle 34. To provide smooth winding and unwinding of the cable 32, pulleys 144 are movable parallel to the axis of the drum 68 as indicated by arrows 146, and pulleys 140 are free to swivel as indicated by arrows 148.

Referring to FIG. 22 wherein only the bracing cables 64 are shown in addition to FIG. 21 where vertical lifting cables 32 are also shown, the bracing cables 64 pass horizontally from pulleys 142 around pulleys 150 and on to pulleys 152 directly below the drum 66. The pulleys 152 direct cables 64 upwardly to drum 66 for winding and unwinding on the drum. Pulleys 152 are movable in a direction parallel to the axis of drum 66, as indicated by arrows 154, to provide smooth winding and unwinding under a tension load preferably provided by a dynamic electric brake and motor combination connected to the drum. Dynamic electric brake and motor combinations are well known in the elevator art, however, in this application the cables 64 act as structural diagonal bracing which changes length as required.

The invention claimed is:

1. A watercraft cradle, for supporting a watercraft having a hull, a stern and a keel, the watercraft cradle comprising a base with a generally U-shaped horizontal framework having a central opening, a length, a plurality of support beams positioned along the length of the U-shaped horizontal framework, a keel block positioned at a stern end of the base and supported by the framework, and at least two platforms continuously extending from opposite of the stern end toward the stern end along at least about half of the length, each platform attached to at least one of the support beams, the central opening positioned horizontally along a majority of the length of the U-shaped horizontal framework, with at least one support beam and the at least two platforms positioned on either side of the framework central opening;

at least one lateral frame piece positioned on the base to support the stern of the watercraft;

at least two sides extending upward from the U-shaped horizontal framework, the sides positioned opposite the central opening and extending along substantially the entire length of the base; and said U-shaped horizontal framework is sized to accept and clear a cantilever storage rack support beam assembly in the central opening.

2. A watercraft storage system comprising the watercraft cradle of claim 1, means for raising, lowering and translating the cradle with a boat thereon, and a plurality of storage racks each having a cantilever storage rack support beam assembly extending therefrom for supporting a boat thereon.

3. The watercraft storage system of claim 2 wherein the means for raising, lowering and translating the cradle with a boat thereon include means to rotate the cradle with a boat thereon.

4. The watercraft storage system of claim 2, including a water-filled channel adjacent the plurality of storage racks, and means in the channel for guiding and locating a boat in the channel over a cradle submerged in the channel.

5. The watercraft storage system of claim 4 wherein the means in the channel move vertically in response to contact with a boat hull.

6. The watercraft storage system of claim 4 wherein the channel includes a catwalk over a portion of the channel, said catwalk being movable vertically and horizontally and having means for attachment to a boat hull.

7. The watercraft cradle of claim 1 wherein the at least two platforms include a plurality of cushioning devices positioned to support at least a portion of the watercraft hull.

8. The watercraft cradle of claim 7 wherein the plurality of cushioning devices are supported by means that can selectably be adjusted horizontally on the horizontal framework.

9. The watercraft cradle of claim 7 wherein the plurality of cushioning devices are supported by means that can selectably be adjusted rotatably relative to the horizontal framework.

10. A watercraft cradle, for supporting a watercraft having a hull, a stern and a keel, the watercraft cradle comprising a base with a generally U-shaped horizontal framework, the base having a length and a width and including:

at least two support beams with each support beam positioned along the length of the base, the support beams defining a central opening positioned horizontally along a majority of the length of the base;

a keel block positioned at a stern end of the base and supported by the framework;

at least two platforms, each platform attached to one of the support beams and spaced from the other support beam across the central opening, the at least two platforms continuously extending from opposite of the stern end toward the stern end along at least about half of the length;

at least one lateral frame piece positioned between and connecting the support beams, and spanning the width of the base;

at least two sides extending upward from the base, the sides positioned opposite the central opening and extending along substantially the entire length of the base.

11. The watercraft cradle of claim 10, further including at least two pairs of support beams with each pair of support beams positioned on each side of the central opening.

12. The watercraft cradle of claim 10, further including at least two lateral frame pieces, each lateral frame piece positioned opposite the opening of the U-shaped horizontal framework.

13. The watercraft cradle of claim 10, wherein the U-shaped horizontal framework is sized to accept and clear a cantilever storage rack support beam assembly in the central opening.

* * * * *